US007083300B2

(12) United States Patent
Sharrah et al.

(10) Patent No.: US 7,083,300 B2
(45) Date of Patent: Aug. 1, 2006

(54) SOLID STATE LIGHT SOURCE, AS FOR A FLASHLIGHT

(75) Inventors: Raymond L. Sharrah, Collegeville Borough, PA (US); Charles W. Craft, Lansdale, PA (US); Robert A. Kline, Douglasville, PA (US)

(73) Assignee: Streamlight, Inc., Eagleville, PA (US)

( * ) Notice: Subject to any disclaimer, the term of this patent is extended or adjusted under 35 U.S.C. 154(b) by 150 days.

(21) Appl. No.: 10/667,745

(22) Filed: Sep. 22, 2003

(65) Prior Publication Data

US 2004/0057233 A1 Mar. 25, 2004

Related U.S. Application Data

(60) Provisional application No. 60/412,914, filed on Sep. 23, 2002.

(51) Int. Cl.
*F21L 4/04* (2006.01)
*F21L 4/00* (2006.01)

(52) U.S. Cl. ..... 362/202; 362/205

(58) Field of Classification Search ..... 362/158, 362/194, 195, 202, 203, 204, 205, 206, 208
See application file for complete search history.

(56) References Cited

U.S. PATENT DOCUMENTS

| | | | | |
|---|---|---|---|---|
| 1,264,520 | A | 4/1918 | Holmes | |
| 1,487,983 | A | 3/1924 | Stiriss | |
| 1,607,647 | A | 11/1926 | Seikot | |
| 1,810,524 | A | 6/1931 | Lyhne | |
| 1,919,024 | A | 7/1933 | Abbotts | |
| 3,835,272 | A | 9/1974 | Wisenbaker | |
| 3,887,803 | A | 6/1975 | Savage, Jr. | |
| 4,176,263 | A | 11/1979 | Rousseau | |
| 4,228,485 | A | 10/1980 | Hubbard et al. | |
| 4,290,095 | A | 9/1981 | Schmidt | |
| 4,346,329 | A | 8/1982 | Schmidt | |
| 4,358,708 | A | 11/1982 | Silva et al. | |
| 4,417,299 | A | 11/1983 | Rupp | |
| 4,547,837 | A * | 10/1985 | Bennett | 362/202 |
| 4,841,417 | A | 6/1989 | Maglica et al. | |
| 4,897,769 | A | 1/1990 | Lang | |
| 4,939,628 | A | 7/1990 | Wang | |
| 5,008,784 | A | 4/1991 | Wang | |
| 5,131,775 | A | 7/1992 | Chen | |
| 5,197,796 | A | 3/1993 | Moore | |
| 5,303,133 | A | 4/1994 | Wagner | |
| 5,642,932 | A | 7/1997 | Matthews | |
| 6,296,371 | B1 | 10/2001 | Shiau | |
| 6,318,879 | B1 * | 11/2001 | Huang | 362/205 |
| 6,347,878 | B1 | 2/2002 | Shiao | |

(Continued)

OTHER PUBLICATIONS

STREAMLIGHT, INC., LED Lamp assembly, Drawing No. C130143, Mar. 1997.
Eveready Lighting Products, Catalog, Spring 1983, 24 Pages.
Promo-lite, Brochure, undated, 4 Pages.

*Primary Examiner*—Y. My Quach-Lee
(74) *Attorney, Agent, or Firm*—Dann, Dorfman, Herrell & Skillman, P.C.

(57) ABSTRACT

A light source assembly comprises a dielectric body having an exterior surface and a light source mounted coaxially proximate an end of the dielectric body. A first electrical lead of the light source provides an electrical lead at an end of the dielectric body distal the solid state light source and a second electrical lead thereof provides an electrical lead at the periphery of the dielectric body. A resilient member improves electrical contact of the second electrical lead at the periphery.

46 Claims, 7 Drawing Sheets

U.S. PATENT DOCUMENTS 6,402,340 B1 6/2002 Sharrah et al.
6,471,064 B1 10/2002 Gordon
6,491,409 B1 12/2002 Sharrah et al.
6,523,972 B1 2/2003 Sharrah et al.
6,811,280 B1 11/2004 Sharrah et al.
6,857,758 B1 2/2005 Sharrah et al.

* cited by examiner

SOLID STATE LIGHT SOURCE, AS FOR A FLASHLIGHT

This Application claims the benefit of U.S. Provisional Patent Application No. 60/412,914 filed Sep. 23, 2002.

The present invention relates to a light source, and in particular to a solid state light source.

Flashlights are available in a wide variety of shapes and sizes, and tailored to a particular use or situation. However, two desires that continue to indicate the need for improved flashlights include the desire for small flashlights and longer useful life. For example, there is a desire for a flashlight that is of a size and shape to conveniently fit in a pocket, e.g., a shirt pocket. In addition, there is a desire for a flashlight that has a bright beam and that operates for a long time before needing to replace or recharge the battery. Also, consumers also want such flashlights to be durable and available at a reasonable cost.

Prior art pocket lights such as a typical pen-shaped light typically are about 1.3 to 2 cm in diameter and are quite heavy, principally due to the size and weight of the type AA (about 1.4 cm diameter) or type AAA (about 1 cm diameter) batteries therein. It would be desirable to have a flashlight of about 1 cm or less in diameter, which is closer to the diameter of typical pens and pencils also kept in a person's pocket. A further advantage of a smaller-diameter flashlight is the ability to shine the light into small spaces.

The desire for a small-diameter flashlight makes the inclusion of complex internal current-carrying conductors undesirable because they tend to increase the diameter of the light, as well as adding cost thereto, i.e. cost for material, cost for fabrication of the internal parts, and added cost for assembly of the flashlight.

Prior art flashlights typically employ filament-type lamps that have a filament that is electrically heated to glow to produce light, wherein the filament is suspended between supports. Typical filaments tend to be fragile, and often more so when they are heated to glowing. As a filament is used, the filament material may thin or become brittle, thereby increasing its susceptibility to breakage. Even high-light-output lamps such as halogen and xenon lamps employ a heated filament, albeit a more efficient light producer than is a conventional incandescent lamp filament. A solid-state light source, such as a light-emitting diode (LED), for example, does not have a heated filament and so is not subject to the disadvantages associated with lamp filaments, and such LEDs are now available with sufficiently high light output as to be suitable for the light source for a flashlight.

A solid state light source is desired for the foregoing and other flashlights, and for utilization in other apparatus. Accordingly, there is a need for a solid state light source that is simple and can be made at a reasonable cost.

To this end, the solid state light source of the present invention comprises a dielectric body having an exterior surface, and a light source mounted coaxially proximate an end of the dielectric body. A first electrical lead of the light source provides an electrical lead at an end of the dielectric body distal the solid state light source and a second electrical lead thereof provides an electrical lead at the periphery of the dielectric body. A resilient member improves electrical contact of the one electrical lead at the periphery.

BRIEF DESCRIPTION OF THE DRAWING

The detailed description of the preferred embodiments of the present invention will be more easily and better understood when read in conjunction with the FIGURES of the Drawing which include.

Figure 1:
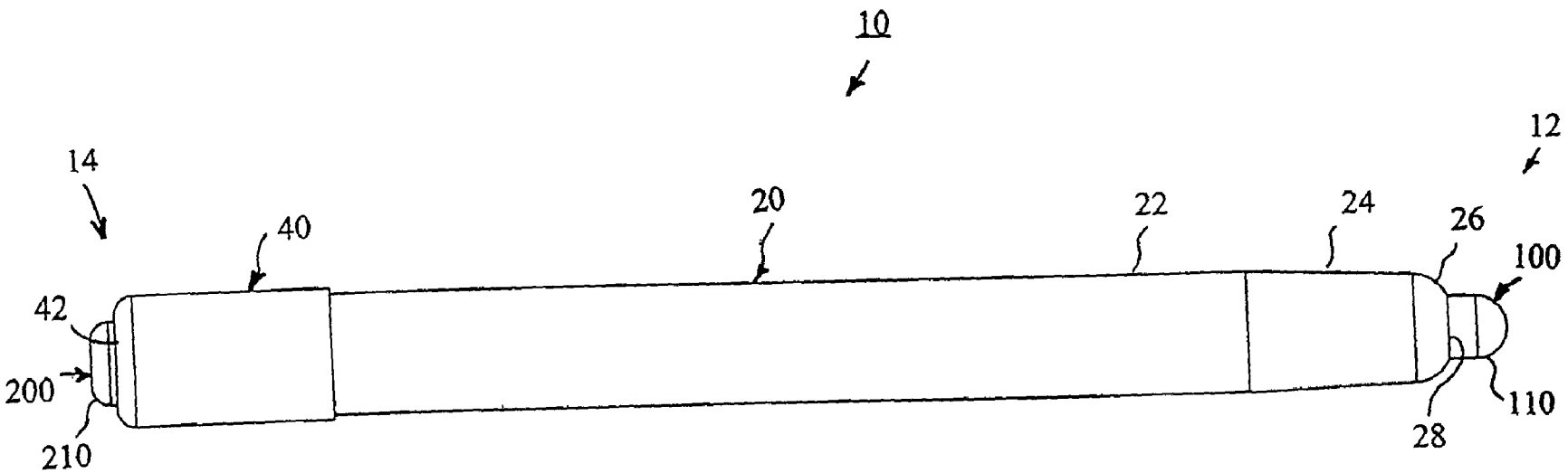
FIG. 1 is a side view of an example embodiment of a flashlight.

In the Drawing, where an element or feature is shown in more than one drawing figure, the same alphanumeric designation is used to designate such element or feature in each figure, and where a closely related or modified element is shown in a figure, the same alphanumerical designation primed or double primed may be used to designate the modified element or feature.

DESCRIPTION OF THE PREFERRED EMBODIMENT(S)

FIG. 1 is a side view of an example embodiment of a flashlight 10. Flashlight 10 has a forward or head end 12 at which light is produced by a light source assembly 100 including a solid-state light source 110 such as an LED, and a rearward or tail end 14 at which is a tail switch assembly 200 including a pushbutton 210. Hollow cylindrical housing 20 of flashlight 10 has an elongated hollow cylindrical portion 22 and a hollow reduced inner diameter portion 24, for example, a tapered portion 24, proximate head end 12. Housing 20 is formed into a generally rounded forward end 26 at head end 12 and has a circular hole therein through which solid state light source 110 of light source assembly 100 projects in a forward direction. Cylindrical tail cap 40 overlies cylindrical housing 20 at the tail end 14 of flashlight 10 and has a circular hole 42 therein through which pushbutton 210 of tail switch assembly 200 projects in a rearward direction. Light source 100 is turned on by either depressing pushbutton 210 or by rotating tail cap 40 further onto housing 20.

Figure 2:
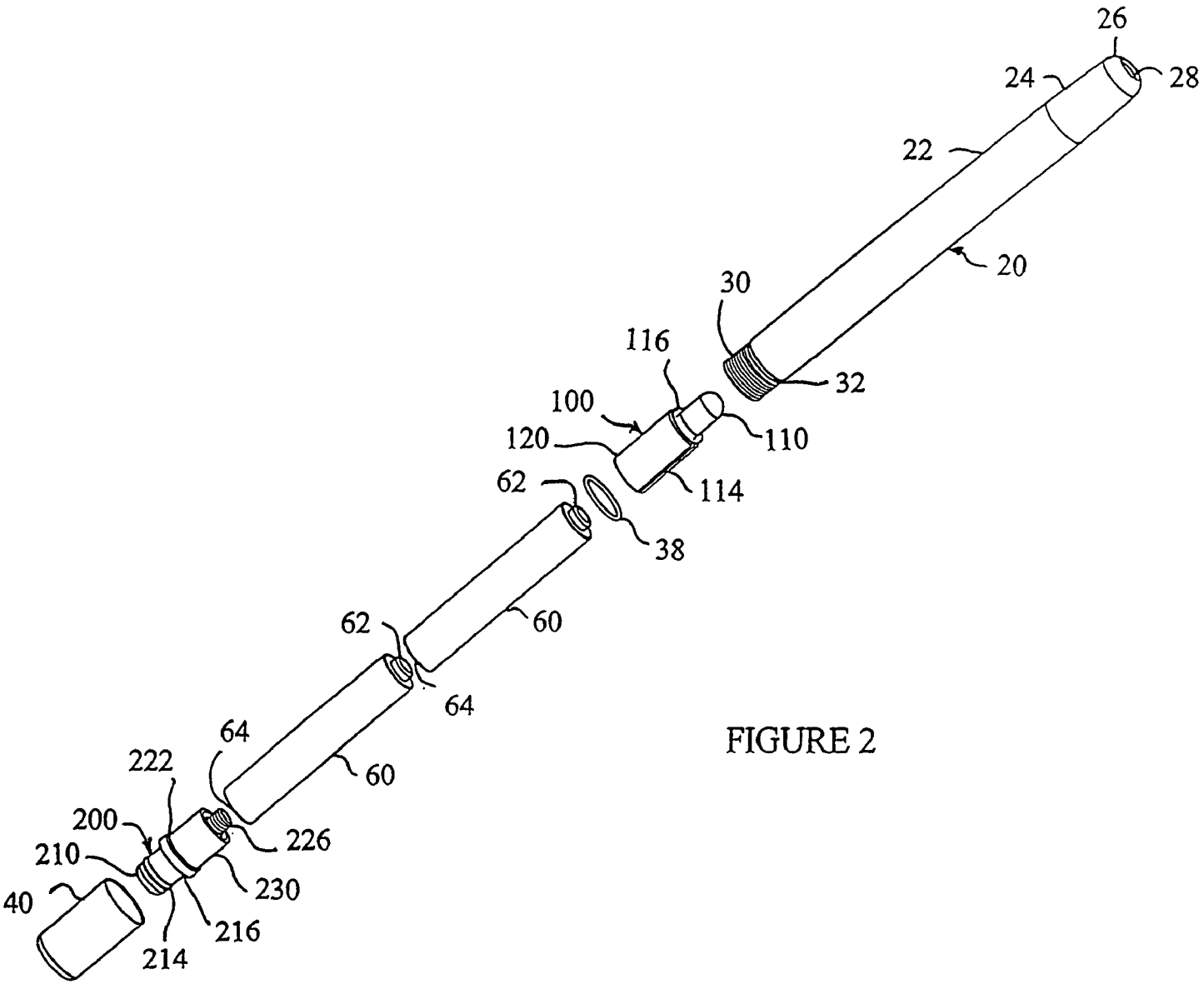
FIG. 2 is an exploded perspective view of the flashlight of FIG. 1.

FIG. 2 is an exploded perspective view of the flashlight 10 of FIG. 1 illustrating the external and internal components thereof. Hollow cylindrical housing 20 includes an elongated hollow cylindrical portion 22 and a hollow reduced inner diameter portion 24, for example, a tapered portion 24, proximate rounded forward end 26 thereof in which is formed circular hole 28 through which the light-emitting lens of light source 110 projects. Tubular housing 20 includes external threads 30 at the rearward end thereof for engaging the internal threads (not visible in FIG. 2) on the inner surface of tail cap 40. Housing 20 has a circumferential groove 32 forward of threads 30 for receiving a resilient O-ring 38 therein that provides a water-resistant seal between housing 20 and tail cap 40.

Internal components that slip inside the hollow cylindrical housing 20 include light source assembly 100 and batteries 60. Light source assembly 100 includes solid state light source 110 mounted in cylindrical base 120 with its electrical lead 114 in a longitudinal slot therein. Resilient O-ring 116 fits over light source 110 to provide a water-resistant seal between light source 110 and housing 20 when light source assembly is installed forward within housing 20 with O-ring 116 bearing against the internal forward surface thereof proximate circular hole 28. Batteries 60 each include a positive terminal 62 and a negative terminal 64 and are connected in series to provide a source of electrical energy for energizing light source 110 to cause it to produce light. Typically, two batteries 60 (as illustrated) or three batteries 60 are employed, although a greater or lesser number could be employed by appropriately lengthening or shortening the length of housing 20. Preferably, batteries 60 are of the type AAAA alkaline cells which provide a voltage of about 1.2–1.5 volts and have a diameter of about 0.8 cm or less. As a result, flashlight 10 has an outer diameter of only about 1 cm (about 0.38 inch), and is 12.6 cm (about 4.95 inches) long for a two-battery flashlight and 16.8 cm (about 6.6 inches) long for a three-battery flashlight, and operates for about 10 hours or more on a set of batteries.

The small outer diameter of flashlight 10 advantageously permits flashlight 10 to be "pocket-sized" in that it is of a size that permits it to be carried in a pocket or pouch, if so desired, although it need not be.

At the rearward or tail end 14 of flashlight 10, tail switch assembly fits inside the central cavity of tail cap 40 with circular pushbutton 210 of tail switch assembly 200 projecting through circular hole 42 in the rearward end thereof. Resilient O-ring 214 on pushbutton 210 provides a water-resistant seal between pushbutton 210 and tail cap 40 when pushbutton 210 is installed therein with O-ring 214 bearing against the interior surface of tail cap 40 proximate circular hole 42 therein.

Selective electrical connection between negative terminal 64 of rearward battery 60 and the rearward end metal housing 20 is made via outwardly extending circular metal flange 222 which is electrically connected to coil spring 226. When push button 210 is depressed or when tail cap 40 is screwed further onto threads 30 of housing 20 moving tail switch assembly 200 forward relative to housing 20, metal flange 222 comes into electrical contact with the rearward annular surface of cylindrical housing 20 thereby to complete an electrical circuit including batteries 60 and light source 110, to the end of applying electrical potential to solid state light source 110 to cause it to emit light.

Figure 3:
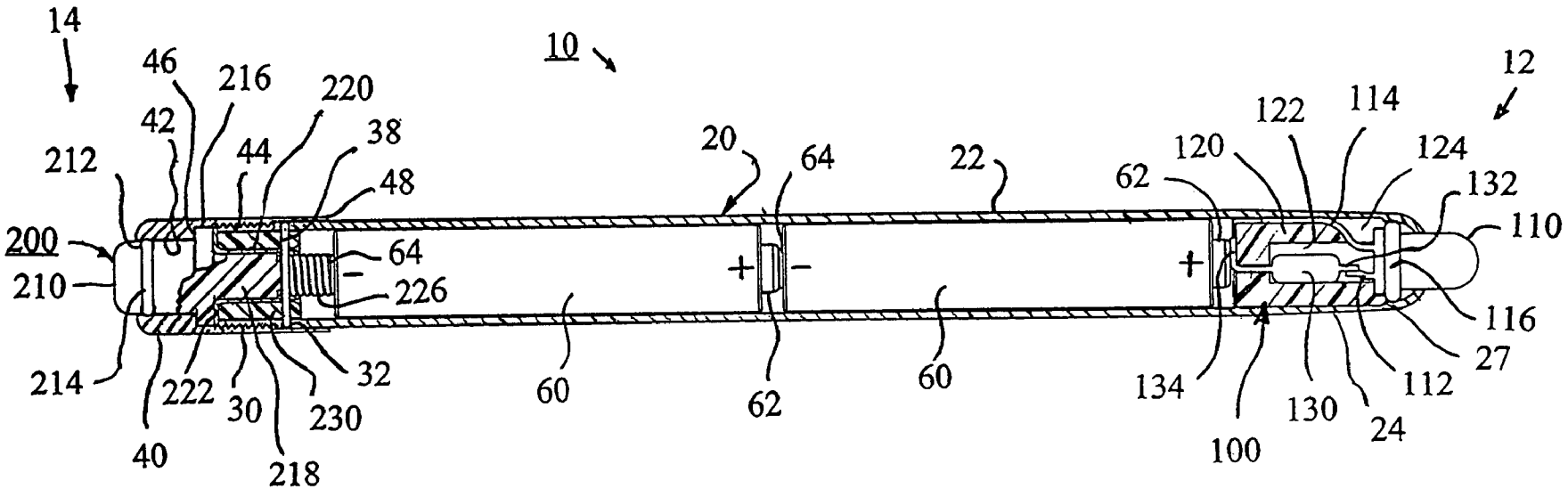
FIG. 3 is a side cross-sectional view of the flashlight of FIG. 1.

FIG. 3 is a side cross-sectional view of the flashlight 10 of FIG. 1 showing the relative positions of the external and internal components thereof when tail cap 40 is screwed onto threads 30 of housing 20 sufficiently to cause metal flange 222 to contact the rear end of housing 20, thereby to energize light source 110 to produce light as described above. Switch assembly 200 is free to move axially forward and rearward within housing 20 and tail cap 40, and does so under the urging of coil spring 226 and pressure applied to pushbutton 210. Unscrewing tail cap 40 moves tail cap 40 rearward and allows switch assembly 200 therein to also move rearward under the urging of spring 226, thereby breaking contact between metal flange 222 and the rear end of housing 20 and breaking the electrical circuit including batteries 60 and LED light source 110, thereby to de-energize light source 110 to stop the producing of light. Momentary switching (or blinking) action obtains from depressing/releasing pushbutton 210 when tail cap 40 is unscrewed slightly from the position illustrated in FIG. 3 and continuous on/off operation obtains by screwing tail cap 40 onto/away from housing 20 sufficiently to cause light assembly 110 to produce and not produce light.

Coil spring 226 urges batteries 60 forward causing their respective positive terminals 62 and negative terminals 64 to come into electrical contact and complete an electrical circuit between metal coil spring 226 and electrical lead 134 of light source assembly 100. In assembling flashlight 10, light source assembly 100 is inserted into housing 20 and is pushed forward causing electrical lead 114 thereof to come into physical and electrical contact with the interior surface of the wall of metal housing 20, e.g., by abutting housing 20 at shoulder 27. Light source assembly 100 is inserted sufficiently far forward to cause O-ring 116 to provide a seal between light source 110 and the interior surface of housing 20 proximate circular hole 28 therethrough. Light source assembly 100 is preferably a press fit into the tapered portion 24 of housing 20 owing to the contact of lead 114 and cylindrical body 120 with the interior surface of tapered portion 24.

Light source assembly 100 includes a solid state light source 110, preferably a light-emitting diode (LED). LEDs are available to emit light of one of a variety of colors, e.g., white, red, blue, amber, or green, and have extremely long expected lifetimes, e.g., 100,000 hours. Light source assembly 100 includes an insulating cylindrical body 120 having a central cavity 122 therein and a longitudinal slot 124 axially along one external surface thereof. LED light source 110 mounts into cylindrical body 120 with one electrical lead 114 thereof lying in slot 124 so as to come into physical and electrical contact with the interior surface of tapered portion 24 of cylindrical housing 20 and with the other electrical lead 112 thereof connected to lead 132 of electrical device 130 within central cavity 122 of cylindrical body 120. The other electrical lead 134 of electrical device 130 projects rearwardly out of the central cavity 122 of cylindrical body 120 to come into electrical contact with the positive terminal 62 of forward battery 60, thereby to complete an electrical circuit between battery 60 and metal housing 20 through LED light source 110. Electrical body 120 is preferably a rigid dielectric material such as a moldable plastic or ceramic, such as a glass-filled PBT plastic.

Electrical device 130 is preferably an electrical resistor with one of its leads 134 contacting battery 60 and the other of its leads 132 connected to lead 112 of LED light source 110 to limit the current that flows therethrough, thereby to extend the life of LED light source 110 and of batteries 60. Resistor 130 is preferably a carbon film resistor, and other types of resistors can be utilized.

Tail switch assembly 200 is positioned within tail cap 40 at the rearward end 14 of flashlight 10. Tail switch assembly 200 includes a generally cylindrical pushbutton 210 of insulating plastic that includes a rearward cylindrical section that projects through hole 42 of tail cap 40 and has a circumferential groove 212 in which resilient O-ring 214 resides to provide a water resistant seal between pushbutton 210 and tail cap 40 proximate hole 42 therein. Tail cap 40 includes a cylindrical skirt 48 extending forwardly from internal threads 44 therein and extending along housing 20.

Tail cap skirt 48 provides an inner surface for sealing tail cap 40 against O-ring 38, and also provides a greater length to tail cap 40 thereby making it easier to grip for rotating tail cap 40 relative to housing 20 to turn flashlight 10 on and off.

Pushbutton 210 also includes a central cylindrical section having a greater diameter than the rearward section thereof to provide an outwardly extending circular flange 216 that engages a corresponding shoulder 46 of tail cap 40 to retain pushbutton 210 captive therein. Forward cylindrical body section 218 of pushbutton 210 is preferably of lesser diameter than the rearward section and circular flange 216 thereof to receive a cylindrical metal ferrule 220 thereon. Metal ferrule 220 receives metal coil spring 226 in the forward cylindrical section thereof and includes circular flange 222 extending radially outward therefrom. Radial flange 222 comes into contact with the rearward end of housing 20 when pushbutton 210 is depressed or when tail cap 40 is rotated clockwise with respect to housing 20 to advance axially forward thereon due to the engagement of the external threads 30 on the external surface of housing 20 and the internal threads 44 of tail cap 40. Insulating plastic cylindrical ferrule 230 surrounds metal ferrule 220 and centers tail switch assembly within the central longitudinal cylindrical cavity of housing 20. Preferably, metal ferrule 220 is a tight fit over cylindrical body section 218 of pushbutton 210 and plastic ferrule 230 is a tight fit over metal ferrule 220 for holding together with a slight press fit, without need for adhesive or other fastening means.

Alternatively, body portion 218, metal ferrule 220 and insulating ferrule 230 may each be tapered slightly for a snug fit when slipped over each other, and metal ferrule 220 may be split axially so as to more easily be expanded and compressed for assembly over body portion 218 and securing thereon by ferrule 230. Metal ferrule 220 is preferably brass, but may be copper, aluminum, steel or other formable metal. Coil spring 226 is preferably stainless steel, but may be of steel, beryllium copper or other spring-like metal.

Housing 20 and tail cap 40 are metal so as to provide an electrically conductive path along the length of flashlight 10, and are preferably of aluminum, and more preferably of 6000 series tempered aircraft aluminum. Housing 20 and tail cap 40 are preferably coated for aesthetics as well as for preventing oxidation of the aluminum metal, and preferably are coated with a durable material such as an anodized finish, which is available in several attractive colors such as black, silver, gold, red, blue and so forth. While an anodized finish is hard and durable, it is not electrically conductive and so, absent the arrangement described, interferes with completing an electrical circuit including batteries 60 and light source 110 through housing 20.

Figure 4:
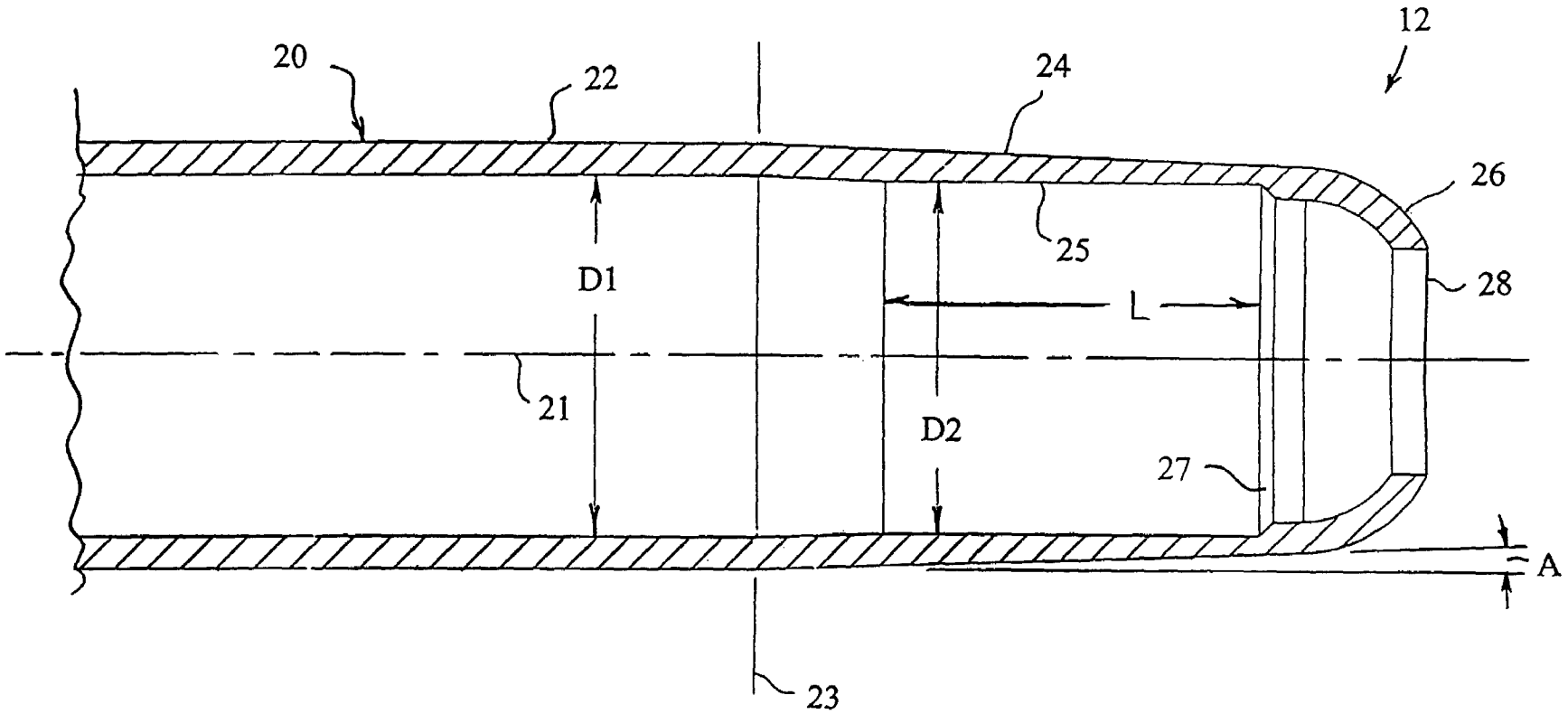
FIG. 4 is an enlarged side cross-sectional view of a portion of the barrel of the flashlight of FIG. 1.

To the end of providing one or more electrical connections to housing 20, FIG. 4 is an enlarged side cross-sectional view of a forward portion of housing 20 of the flashlight 10 of FIG. 1. Housing 20 is preferably formed from a cylindrical aluminum tube or tube stock, such as an extruded cylindrical tube, preferably an aluminum tube having an outer diameter of about 1 cm or less, as follows. A length of aluminum tube is cat to a length slightly longer than the axial length of housing 20 and one end thereof forward of break line 23 is roll formed, preferably cold roll formed, so as to have a slight narrowing taper, thereby forming tapered portion 24 of housing 20 having an inner diameter that is less than the inner diameter of the remainder of housing 20 proximate the forward or head end 12 thereof. A taper angle A of less than about 5° from the longitudinal center axis 21 is desirable. In fact, for an about 1 cm diameter tube, a taper of about 2° is preferred. Housing 20 is further roll formed at the head end 12 of tapered portion 24 to form a rounded forward end 26 having a narrowed-diameter opening therein that is trimmed, such as by drilling or boring, to provide circular hole 28 coaxially with housing centerline 21. The roll forming of tapered portion 24 and rounded end 26 maybe performed in a single operation. Housing 20 is coated with the preferred anodized or other finish, preferably before the forming and subsequent operations.

Because the preferred anodized finish is not electrically conductive, it must be removed at locations on housing 20 at which electrical connection is to be made. To this end, the reduced inner diameter tapered forward portion 24 of housing 20 provides a particular advantage, it being noted that the rolling tapers both the outer and inner surfaces of tapered portion 24. Because the aluminum tube is tapered only at its forward end, the interior diameter of housing 20 is of uniform inner diameter D1 over its entire length except at tapered portion 24 forward of break line 23 where it has a reduced diameter. Thus, a reamer or boring tool of diameter D2 greater than the inner diameter of the reduced inner diameter portion 24 and less than the inner diameter D1 of the remainder of housing 20 will remove the insulating coating only in the reduced inner diameter portion 24 of housing 20 and form a ridge or shoulder 27 at the forward end thereof. A housing 20 so formed may have a cylindrical outer shape or other outer shape, as is desired. The clearance reamer or other boring tool is inserted into the interior of housing 20 from the tail end 14 thereof and through cylindrical portion 22 thereof and includes a cutting head that cuts a bore of diameter D2 that is less than the inner diameter D1 of cylindrical portion 22, and so does not cut within portion 22 and remove the electrically insulating coating therefrom, and may include a non-cutting guide of a diameter greater than D2, but less than D1, rearward of its cutting head for centering the boring tool substantially coaxially along centerline 21 of housing 20.

As the clearance reamer or boring tool advances forwardly into tapered portion 24, it cuts a cylindrical bore 25 of diameter D2 interior to tapered portion 24, thereby cutting through the non-conductive anodized coating to expose the conductive aluminum metal of housing 20, to provide a contact area to which electrical lead 114 of light source assembly 100 makes electrical contact when light source assembly 100 is inserted into housing 20 and advanced forwardly therein until light source 110 abuts, i.e. is proximate to, shoulder 27 and extends through hole 28. The diameter D2 and length L of bore 25 are selected to provide sufficient exposed aluminum contact surface in bore 25 while leaving sufficient thickness in the forward end of the wall of tapered portion 24 of housing 20. Typically, housing 20 has an outer diameter of about 0.95 cm, an inner diameter of about 0.80 cm, and bore 25 has a diameter D2 of about 0.79 cm and a length L of about 0.9–1.0 cm.

The rearward end 14 of housing 20 has external threads 30 formed on the outer surface thereof, such as by machining or cold forming, and the anodized finish is removed from rearward end of housing 20, such as by machining or grinding, so as to expose the metal of housing 20 to provide a location to which circular flange 222 of metal ferrule 220 can make electrical contact.

Alternatively, the boring tool utilized to cut bore 25 in tapered portion 24 may also include a second cutting head of lesser diameter located forward of the cutting head that cuts bore 25, wherein the second more-forward cutting head is utilized to bore hole 28 in a single operation with the cutting of bore 25.

While housing 20 has been described in terms of tapered portion 24 of housing 20 having an interior surface that is tapered so that a reamer or boring tool may be utilized to remove the electrically insulating anodize coating therefrom, any form of housing 20 having a reduced inner diameter portion 24 near the forward end 12 thereof that a reamer or boring tool or other like tool may be utilized to remove the electrically insulating coating therefrom. Thus, a housing having a reduced inner diameter portion 24 is satisfactory irrespective of whether or not the exterior surface of the reduced inner diameter portion 24 of housing 20 is of the same, smaller or larger outer diameter than is the rest of housing 20 and irrespective of whether the shape of the outer surface of reduced inner diameter portion 24 of housing 20 is the same as or different from the shape defined by the inner surface of reduced inner diameter portion 24 thereof.

Accordingly, housing 20 may be formed by thin-wall impact extrusion wherein a blank or perform of metal such as aluminum is deep drawn to form a cylindrical housing 20 having a cylindrical interior bore that is of a given diameter except at the forward end thereof at which it has a reduced inner diameter. The reduced inner diameter portion may be a tapered interior shape or may be a smaller diameter cylindrical bore, for example. In impact extrusion, which can be utilized in quickly forming relatively deep closed-ended metal objects such as food and beverage cans and cigar tubes, a blank of material to be extruded is forced into a cavity tool that has a cavity of substantially the same size and shape as the desired outer shape of the extruded object to determine the outer shape thereof. The blank is forced into the cavity of the cavity tool by a core tool that has an outer shape that is substantially the same size and shape as the desired inner surface of the extruded object. The shape and size of the elongated closed-ended tube so formed by impact extrusion is defined by the generally cylindrical gap between the cavity tool and the core tool when the core tool is fully driven into the cavity of the cavity tool, similarly to a mold. The extruded object is removed from the cavity and core tools and is trimmed to the desired length of the extruded object.

Housing 20 formed by impact extrusion is removed from the cavity and core tools and the rearward end thereof is cut to the desired length. The resulting extruded hollow tube is then coated with an insulating coating such as an anodize coating. Thus, a reamer or boring tool of diameter greater than the inner diameter of the reduced inner diameter portion 24 and less than the inner diameter of the remainder of housing 20 will remove the insulating coating only in the reduced inner diameter portion 24 of housing 20, and may include a portion forward of the reamer or boring tool portion for substantially contemporaneously cutting opening 28 in the forward end of housing 20. A housing 20 so formed by thin wall impact extrusion may have a cylindrical outer shape or other outer shape, as is desired.

Alternatively, housing 20 may be formed by boring or drilling an interior bore into a solid piece of material, such as a rod or bar of aluminum or other metal, for example. The drilling or boring of such deep small-diameter holes is usually referred to as "gun boring." The drilling or boring tool can have a smaller-diameter forward portion and a larger-diameter rearward portion so as to drill or bore a hole having a reduced inner diameter forward portion 24, which forward portion 24 may be a cylindrical bore or a tapered bore or other reduced inner diameter bore. Housing 20 is then coated with an insulating coating, such as an anodize coating or a paint or a powder coating. Thus, a reamer or boring tool of diameter greater than the inner diameter of the reduced inner diameter portion 24 and less than the inner diameter of the remainder of housing 20 will remove the insulating coating only in the reduced inner diameter portion 24 of housing 20, and may include a portion forward of the reamer or boring tool portion for substantially contemporaneously cutting opening 28 in the forward end of housing 20. A housing 20 so formed by gun boring may have a cylindrical outer shape or other outer shape, as is desired.

Figure 5:
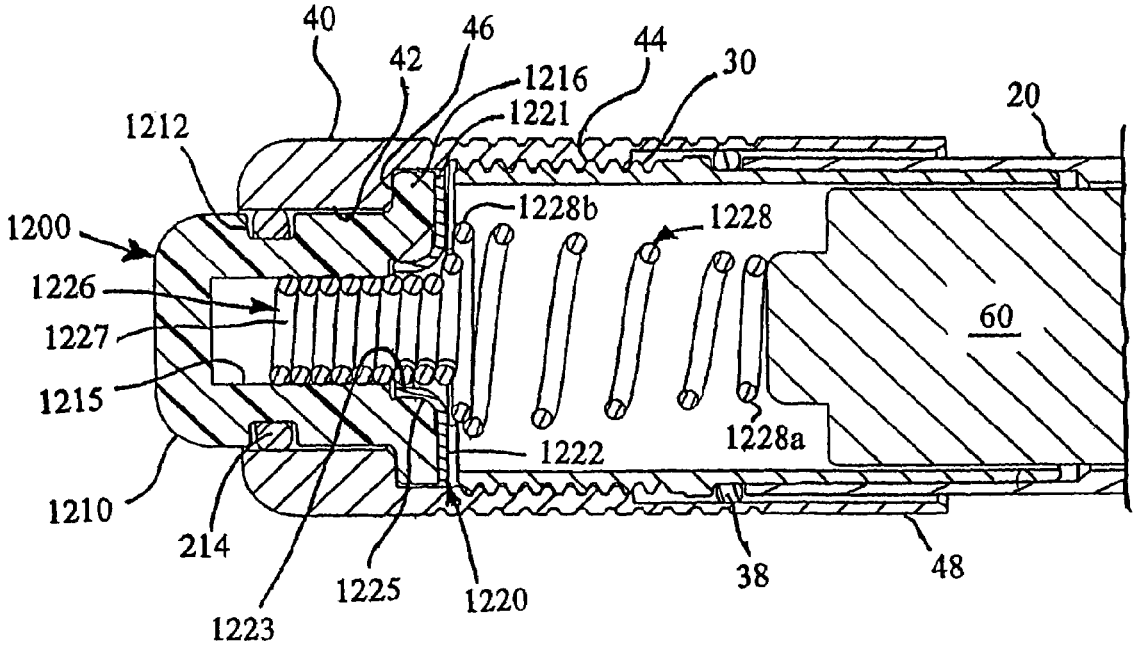
FIG. 5 is an enlarged side cross-sectional view of a portion of the flashlight of FIG. 1 including an embodiment of a switch assembly therefor.

FIG. 5 is an enlarged side cross-sectional view of a portion of the flashlight 10 of FIG. 1 including an embodiment of a switch assembly 1200 therefor. Tail cap 40 is threaded onto threads 30 of housing 20 and switch assembly 1200 is disposed therein for making selective electrical connection between battery 60 in housing 20 and the end of housing 20. Selective electrical connection between housing 20 and battery 60 is made via spring 1226 and metal contact 1220 when pushbutton 1210 is moved forward towards housing 20 sufficiently for metal contact 1220 to contact the end of housing 20. FIG. 5 illustrates the un-energized or unactuated condition wherein metal contact 1220 and pushbutton 1210 are urged away from housing 20 by spring 1226, thereby leaving a space or gap between metal contact 1220 and housing 20. The energized or actuated condition obtains when metal contact 1220 is moved forward to contact housing 20 and complete the electrical circuit including batteries 60 and light source 100.

Such forward movement of metal contact 1220 may be provided by depressing pushbutton 1210 to move it and metal contact 1220 forward towards housing 20, which provides a momentary connection while pushbutton 1220 is depressed. A continuous connection may be provided by rotating tail cap 40 relative to housing 20 so that tail cap 40, and pushbutton 1210 and metal contact 1220 therein, advance towards housing 20 due to the external screw threads 30 of housing 20 and the internal threads 44 of tail cap 40, respectively, until metal contact 1220 touches housing 20 and the space or gap is closed. Thus, the switching operation of switch assembly 1200 to selectively energize light source 110 is like that of switch assembly 200 described above.

Figure 6:
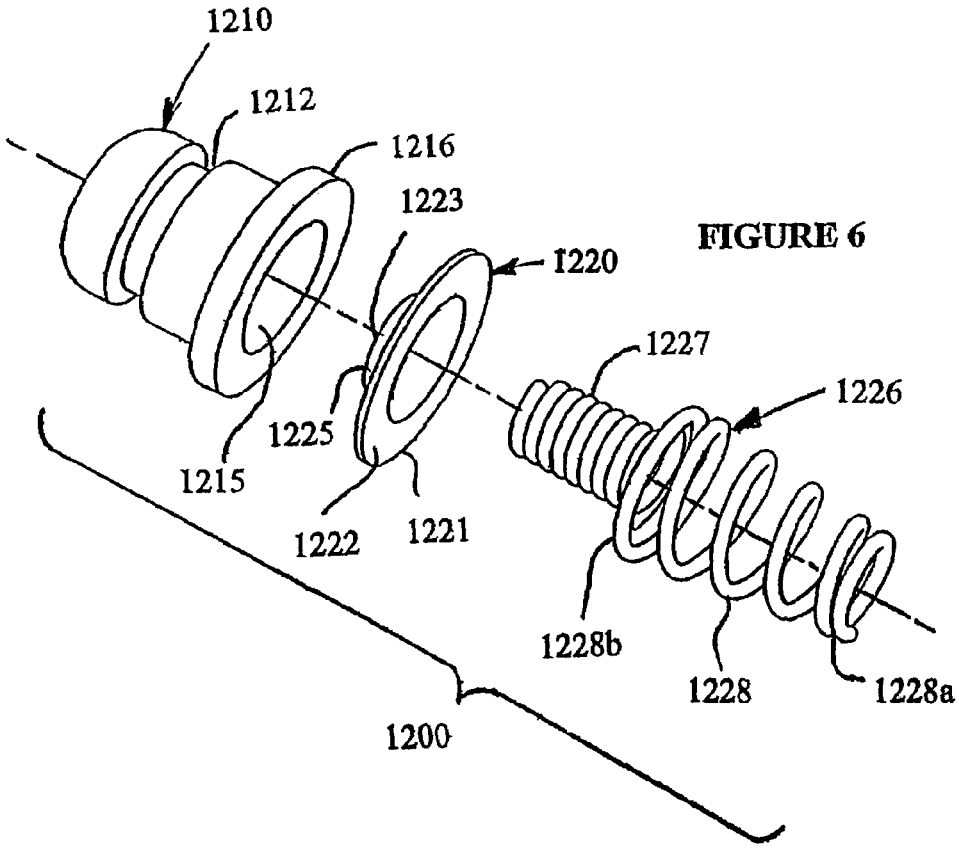
FIG. 6 is an exploded isometric view of the embodiment of the switch assembly of FIG. 5.

Switch assembly 1200 may be understood by considering FIG. 5 in conjunction with FIG. 6 which is an exploded isometric view of the embodiment of switch assembly 1200. Pushbutton 1210 is generally cylindrical and of slightly smaller diameter than the hole 42 of tail cap 40 so as to be axially movable therein. Pushbutton 1210 has an outwardly extending circular flange 1216 against which shoulder 46 of tail cap 40 may bear to limit movement of pushbutton 1210 in the direction away from housing 20. Pushbutton 1210 has an internal cavity or recess or bore 1215 that may provide an engaging feature for receiving a corresponding engaging feature of metal contact 1220 or for receiving a portion 1227 of spring 1226, as described below. Pushbutton 1210 may be of an insulating material or have an insulating coating where tail cap 40 is electrically conductive.

Metal contact 1220 is substantially a flat metal disk that provides selective electrical connection between battery 60 and housing 20. Circular flange 1222 of metal contact 1220 has a circular periphery 1221 and a diameter that is smaller than the diameter of the interior cavity of tail cap 40 and that is at least as great as the interior diameter of the end of housing 20. Preferably, metal contact 1220 has a central hole 1223 in which a portion 1227 of spring 1226 resides to provide electrical contact therebetween. While such contact may be by spring 1226 physically touching metal contact 1220 as is typical, electrically conductive adhesive or solder may be utilized, if desired.

Metal contact 1220 may be a flat metal disk or washer, or may be an eyelet or ferrule, in any case having a circular periphery 1221 and being centered relative to tail cap 40 and/or pushbutton 1210. The centering feature 1225 of contact 1220 is complementary in shape and size to the centering cavity 1215 of pushbutton 1210 so that when the complementary features 1215, 1225, are engaged, the desired relative radial positional relationship obtains.

Spring 1226 urges metal contact 1220 away from battery 60 and housing 20, and because such urging causes metal contact 1220 to bear against pushbutton 1210, pushbutton 1210 is also urged away from battery 60 and housing 20. Preferably, spring 1226 is a coil spring and also preferably, coil spring 1226 has a smaller diameter portion 1227 and a larger diameter portion 1228. An advantage of this coil spring 1226 arrangement is that the coil thereof in the transition between larger diameter portion 1228 and smaller diameter portion 1227 bears against metal contact 1220 to provide positive contact and electrical connection thereto. Also preferably, coil spring 1226 is a so-called "Christmas-tree" spring wherein the smaller diameter portion 1227 is cylindrical and the larger diameter portion 1228 is of non-uniform diameter. In one preferred embodiment, larger diameter portion 1228 of coil spring 1226 is conical with its base 1228*b* bearing against metal contact 1220 and its narrow end 1228*a* contacting battery 60.

Optionally, but preferably, the diameters of narrow portion 1227 of spring 1226 and of the cavity or bore 1215 of pushbutton 1210 may be selected for a snug or interference fit of spring 1226 in pushbutton 1210, whereby spring 1226 engages the interior surface of the cavity or pushbutton 1210 and so pushbutton 1210, metal contact 1220 and spring 1226 tend to remain together once assembled into switch assembly 1200. Other springs, such as spring 226, for example, could also be employed. It is noted that the urging action of spring 1226 typically causes metal contact 1220 to bear against or abut circular flange 1216 of pushbutton 1210 with the centering projection 1225 engaging the cavity 1215 of pushbutton 1210, thereby tending to center contact 1220 relative to pushbutton 1210.

Metal contact 1220 may be centered with respect to pushbutton 1210 and/or tail cap 40, as is desirable when tail cap 40 is electrically conductive, by one or more of the following means. Cylindrical spring portion 1227 passing through the opening 1223 of metal contact 1220 and into the cavity or bore of pushbutton 1210 may serve to center metal contact 1220. Further, the cavity or recess 1215 of pushbutton 1210 may be shaped or contoured so as to be symmetrical about its central axis and the central region 1225 of metal contact 1220 may be similarly shaped or contoured in a complementary manner. Suitable shapes may include a portion of a sphere, a cone and/or a dome, a dimple or a bevel or a chamfer, or any other shape or contour that provides complementary engaging features on metal contact 1220 and pushbutton 1210, or any other shape that otherwise centers metal contact 1220 relative to pushbutton 1210 or that maintains metal contact 1220 and pushbutton 1210 in predetermined radial positions. Typically, such centering feature is radially symmetric relative to the axial axes of pushbutton 1210 and/or contact 1220. Also typically, the desired radial position of contact 1220 is centered, or substantially coaxial, with respect to pushbutton 1210 and/or tail cap 40.

As illustrated in the embodiment of FIGS. 5 and 6, metal contact 1220 has a flat outward radial flange 1222 for providing a selective electrical contact with housing 20 and has an axial projection 1225 for engaging pushbutton 1210 for providing centering of contact 1220 relative to pushbutton 1210, i.e. so that contact 1220 and pushbutton 1210 are substantially coaxial. It is noted that the centering projection 1225 of metal contact 1220 defines the hole or central opening 1223 therein. It also is noted that the radial positioning, e.g., centering, of metal contact or ferrule 1220 is similar to the radial positioning of metal ferrule 220 relative to pushbutton 210 and/or tail cap 40, as described above.

Figure 7:
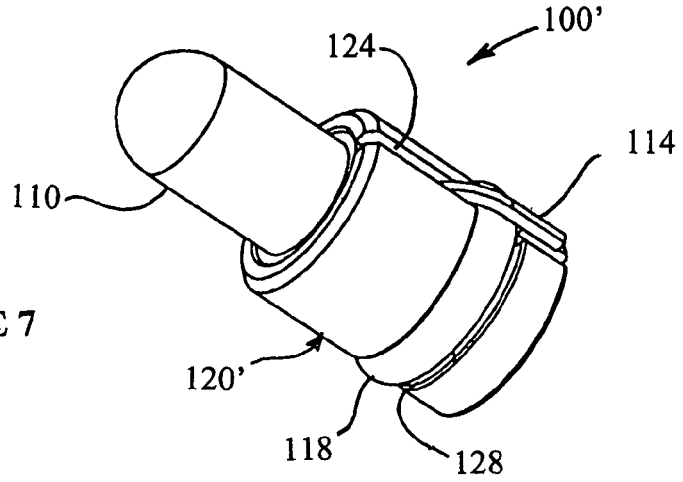
FIG. 7 is an isometric view of an embodiment of a light source assembly of the flashlight of FIGS. 1–4.
Figure 8A:
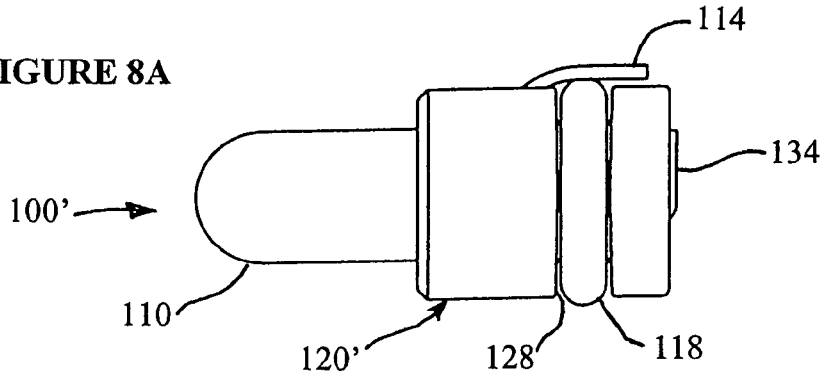
FIGS. 8A and 8B are side views of the light source assembly of FIG. 7 with the view of FIG. 8B being rotated 90° relative to that of FIG. 8A.
Figure 8B:
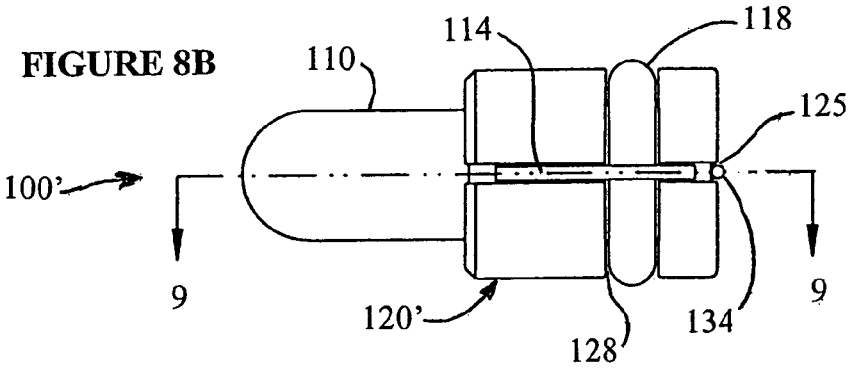

FIG. 7 is an isometric view of a light source assembly 100' of the flashlight of FIGS. 1–4, and FIGS. 8A and 8B are side views of the light source assembly 100' of FIG. 7 with the view of FIG. 8B being rotated 90° relative to that of FIG. 8A. Solid state light source assembly 100', like light source assembly 100 described above, comprises a cylindrical body 120' of a dielectric material having a central cavity and having a longitudinal slot or groove 124 on an exterior surface thereof. LED light source 110 is mounted coaxially proximate a first end of cylindrical body 120' and has first and second electrical leads extending from an end thereof proximate cylindrical body 120'. One electrical lead 112 (not visible) of LED 110 is disposed in the central cavity of cylindrical body 120' and may extend through body 120' to provide an electrical contact 134 at the rearward end thereof. Lead 112 may be bent to be positioned in a slot or groove 125 on the rearward end of body 120'. A second electrical lead 114 of LED 110 is disposed in longitudinal slot 124 of cylindrical body 120' to provide a contact 114 at the periphery thereof.

Light source assembly 100' differs from light source assembly 100 in that cylindrical body 120' has a flexible and/or resilient member 118 between the cylindrical body 120' and lead 114 for urging lead 114 away from body 120'. In particular, a recess such as a circumferential groove 128 is provided in cylindrical body 120' in which a flexible and/or resilient member such as O-ring 118 is disposed. The rearward end of lead 114 is biased radially away from cylindrical body 120', i.e. away from the bottom of groove 124, by O-ring 118 so as to contact the interior surface of the bore 24 of housing 20 when therein.

Resilient member or O-ring 118 may be of suitable flexible and/or resilient material, such as silicone, nitrile rubber, neoprene, rubber, Santoprene, plastic, and the like, and may be either electrically insulating or electrically conductive. In a preferred electrically conductive O-ring 118, the flexible and/or resilient material is either an electrically conductive material or is filled with electrically conductive particles, such as particles of copper, silver, carbon, brass, gold, nickel, graphite, silver-glass, silver-copper, silver-nickel, or any other suitable electrically conductive material, thereby to provide circumferential electrical contact to housing 20 when therein, in addition to direct contact by lead 114. Resilient member 118 need not fill groove 128, either in width and/or in length, but need only be sufficiently large to urge lead 114 radially outward.

Figure 9:
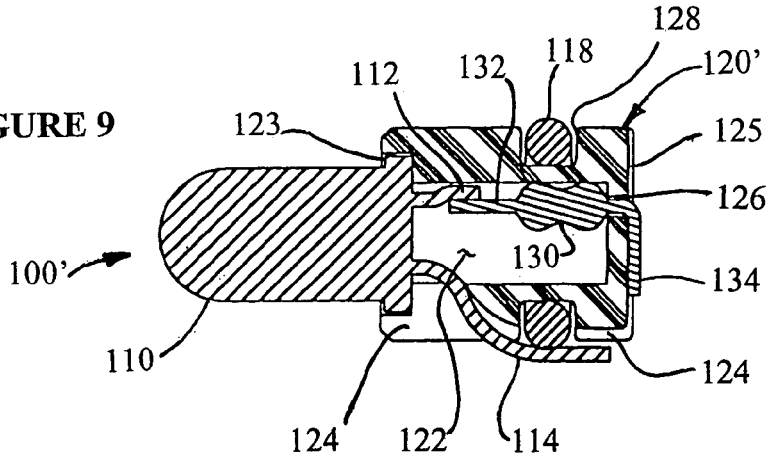
FIG. 9 is a cross-sectional side view of the light source assembly of FIGS. 7, 8A and 8B.

FIG. 9 is a cross-sectional side view of the light source assembly of FIGS. 7, 8A and 8B. Light source assembly 100' includes a solid state light source 110, preferably a light-emitting diode (LED). LEDs are available to emit light of one of a variety of colors, e.g., white, red, blue, amber, or green, and have extremely long expected lifetimes, e.g., 100,000 hours. Light source assembly 100' includes an insulating cylindrical body 120' having a central cavity 122 therein and a longitudinal slot 124 axially along one external surface thereof. LED light source 110 mounts into cylindrical body 120' with one electrical lead 114 thereof lying in optional longitudinal slot 124 so as to come into physical and electrical contact with the interior surface of tapered portion 24 of cylindrical housing 20. The other electrical lead 112 of LED 110 is connected to lead 132 of electrical device 130 within central cavity 122 of cylindrical body 120'. The other electrical lead 134 of electrical device 130 projects rearwardly out of the central cavity 122 of cylindrical body 120' to come into electrical contact with the positive terminal 62 of forward battery 60, thereby to complete an electrical circuit between battery 60 and metal housing 20 through LED light source 110. Thus, electrical lead 112 extends through body 120' to provide (via device 130) a contact 134 at the end thereof distal LED 110.

Dielectric body 120' is preferably a rigid dielectric material such as a moldable plastic or ceramic, such as a Valox® plastic, glass-filled PBT plastic, nylon, polyethylene, polycarbonate, PVC, and/or other insulating material.

Electrical device 130 is preferably an electrical resistor with one of its leads 134 contacting battery 60 and the other of its leads 132 connected to lead 112 of LED light source 110 to limit the current that flows therethrough, thereby to extend the life of LED light source 110 and of batteries 60. Resistor 130 is preferably a carbon film resistor, and other types of resistors can be utilized.

Although central cavity 122 of cylindrical body 120, 120' need only be an axial hole (not necessarily along an axis of body 120, 120' and typically not along its axis) for lead 112 of light source 110 to pass through to extend therethrough to provide a lead 134 at the rearward end thereof, cavity 122 typically has features facilitating the assembly of light source assembly 100, 100'. For example, central cavity 122 typically includes a larger central region in which electrical device 130 is disposed wherein a lead of device 130 extends through the rearward hole or opening 126 of body 120, 120' to provide lead or contact 134. Central cavity 122 typically has a larger diameter recess 123 at the forward end thereof for receiving a base of light source 110 and generally centering light source 110 and body 120, 120', e.g., rendering them substantially co-axial.

Circumferential groove 128 of dielectric body 120' intersects the longitudinal slot 124, wherein resilient member 118, e.g., O-ring 118, is disposed in the circumferential groove 128 of dielectric body 120'. The cross-sectional diameter of O-ring 118 may be larger than the depth of groove 128 so that part of O-ring 118 is in groove 118 and part extends out of groove 128. A sealing O-ring 116 may surround the body of light source 110 as described above.

Figure 10:
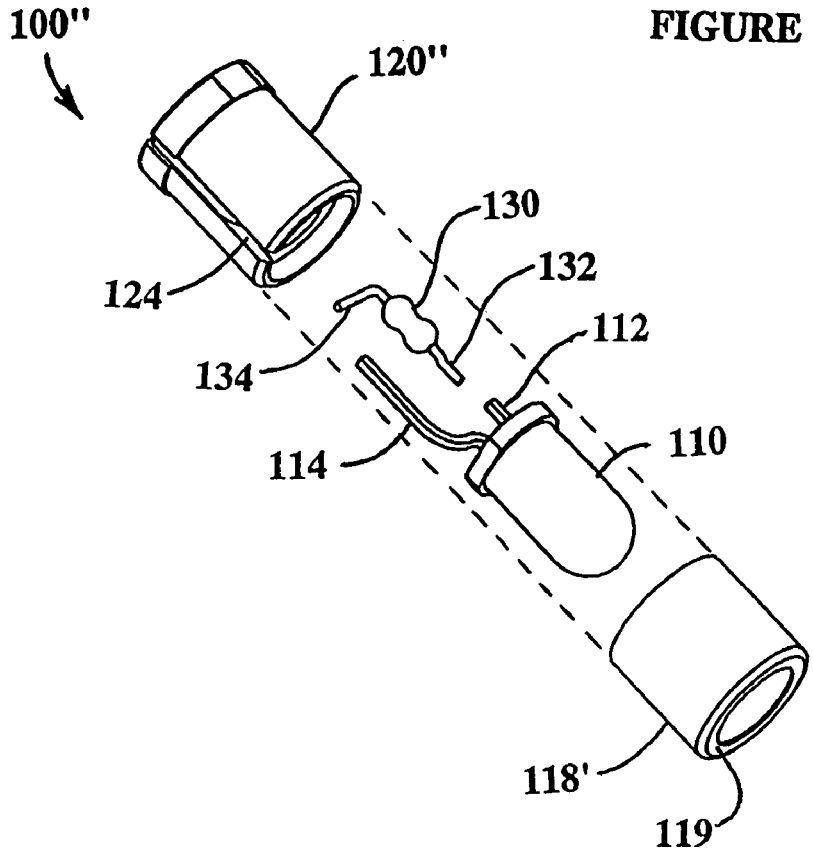
FIG. 10 is an exploded perspective view and FIG. 11 is a cross-sectional view of another embodiment of a light source assembly for the flashlight of FIGS. 1–4.
Figure 11:
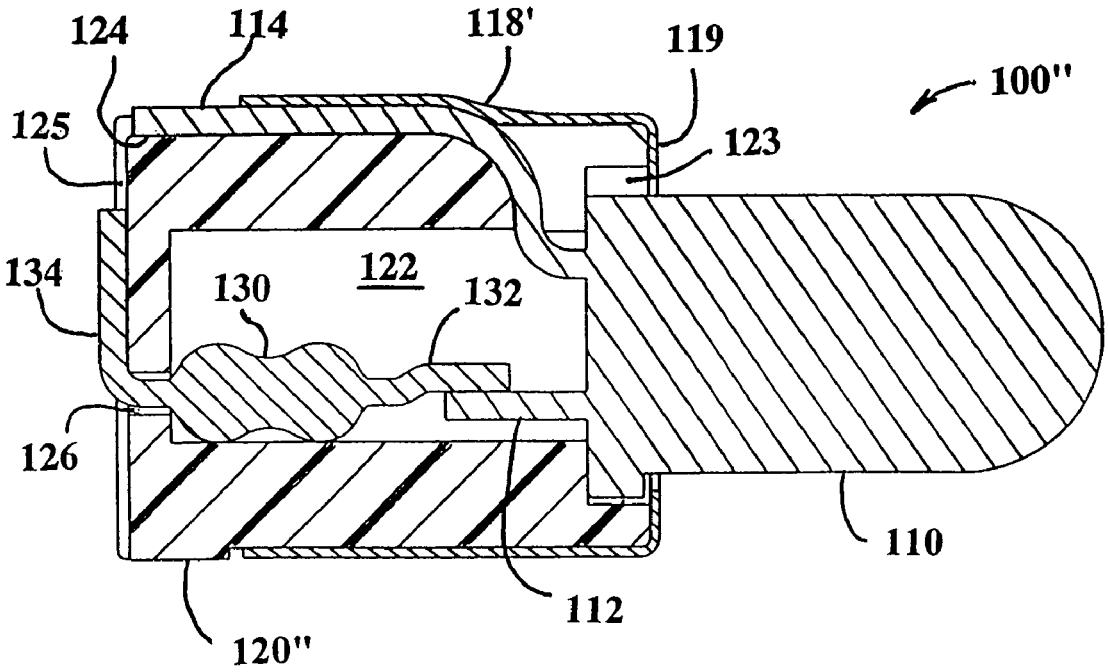

FIG. 10 is an exploded perspective view and FIG. 11 is a cross-sectional view of another embodiment of a light source assembly suitable for the flashlight of FIGS. 1–4. Solid state light source assembly 100", like light source assembly 100 and 100' described above, comprises a body 120" of a dielectric material having a central cavity and having a longitudinal slot or groove 124 on an exterior surface thereof. LED light source 110 is mounted coaxially proximate a first end of cylindrical body 120" and has first and second electrical leads 112, 114 extending from an end thereof proximate cylindrical body 120". One electrical lead 112 of LED 110 is disposed in the central cavity 122 of cylindrical body 120" and may extend through body 120" to provide an electrical contact 134 at the rearward end thereof and in such case, for example, the lead of LED 110 would extend through hole 126 and would be bent to be positioned in a slot or groove 125 on the rearward end of body 120" to provide electrical contact 134. Lead 112 of LED 110 may, for example, extend through cylindrical body 120" via a connection to lead 132 of electrical device 130 within central cavity 122 of cylindrical body 120" as illustrated and the other lead 134 of electrical device 130 which projects rearwardly from cylindrical body 120" provides electrical contact 134. A second electrical lead 114 of LED 110 is disposed in longitudinal slot 124 of cylindrical body 120" to provide a contact 114 at the periphery thereof.

Light source assembly 100" differs from light source assembly 100 in that cylindrical body 120" has a flexible and/or resilient member 118' bearing against cylindrical body 120" and lead 114 for providing a contact for lead 114 at the periphery of body 120". In particular, an electrically conductive flexible and/or resilient annular member surrounds body 120" and lead 114 so as to be in electrical contact therewith. The exterior of metal member 118' is biased radially away from cylindrical body 120" by lead 114 so as to contact the interior surface of the bore 24 of housing 20 when therein.

Resilient member 118', which may be a metal sleeve or ring, may be of suitable flexible and/or resilient material, such as brass, copper or aluminum, or other soft metal or material, and is electrically conductive. Alternatively, member 118' may be a material filled with electrically conductive particles, such as particles of copper, silver, carbon, brass, gold, nickel, graphite, silver-glass, silver-copper, silver-nickel, or any other suitable electrically conductive material, thereby to provide circumferential electrical contact to housing 20 when therein, providing contact to lead 114. Resilient member 118' is preferably thin, e.g., about 10–12 mils (about 250-200 μm), e.g., so as to be resilient or deformable or flexible, and preferably has a rolled over end 119 so as to resemble a cup with a larger opening in one end thereof and a smaller opening in the other end thereof through which LED 110 extends. Resilient member 118' may be an electrically conductive sleeve or ring or cup or helical member or any other suitable shape that extends around body 120" and lead 114 and bears there against for providing an electrical contact thereto at the periphery of light source 100". Member 118' may extend partially around body 120", e.g., by 180° or more, or may surround body 118', e.g., 360° as shown.

Typically, resilient electrically conductive member 118' is a press fit over body 120" and lead 114 of LED 110, and is relatively thin so as to be sufficiently flexible and/or resilient to deform and conform to the shape of body 120" and lead 114. Typically, LED assembly 110" including resilient member 118' is a press fit into bore 24 of housing 20, and may deform to conform to the shape thereof for providing electrical contact therewith.

FIG. 11 is a cross-sectional side view of the light source assembly of FIG. 10. Light source assembly 100" includes a solid state light source 110, preferably a light-emitting diode (LED). LEDs are available to emit light of one of a variety of colors, e.g., white, red, blue, amber, or green, and have extremely long expected lifetimes, e.g., 100,000 hours. Light source assembly 100" includes an insulating cylindrical body 120" having a central cavity 122 therein and an optional longitudinal slot 124 axially along one external surface thereof. LED light source 110 mounts into cylindrical body 120" with one electrical lead 114 thereof lying in optional longitudinal slot 124 so as to be in a position to come into physical and electrical contact with the interior surface of tapered portion 24 of housing 20 when light source 100" is therein.

The other electrical lead 112 of LED 110 connects to lead 132 of electrical device 130 within central cavity 122 of cylindrical body 120". The other electrical lead 134 of electrical device 130 projects rearwardly out of the central cavity 122 of cylindrical body 120" to come into electrical contact with the positive terminal 62 of forward battery 60, thereby to complete an electrical circuit between battery 60 and metal housing 20 through LED light source 110. Thus, electrical lead 112 extends through body 120" to provide (via device 130) a contact 134 at the end thereof distal LED 110.

Body 120" is preferably a rigid dielectric material and electrical device 130 is preferably an electrical resistor as described above. Lead 134 thereof preferably is bent for contacting battery 60 and the other of its leads 132 connects to lead 112 of LED light source 110.

Although central cavity 122 of cylindrical body 120, 120', 120" need only be an axial hole (not necessarily along an axis of body 120, 120', 120" and typically not along its axis) for lead 112 of light source 110 to pass through to extend therethrough to provide a lead 134 at the rearward end thereof, cavity 122 typically has features facilitating the assembly of light source assembly 100, 100', 120". For example, central cavity 122 typically includes a larger central region in which electrical device 130 is disposed wherein a lead of device 130 extends through the rearward hole or opening 126 of body 120, 120', 120" to provide lead or contact 134. Central cavity 122 typically has a recess 123 (which is of larger diameter than the main chamber of cavity 122) at the forward end thereof for receiving a base of light source 110 and generally centering light source 110 and body 120, 120', 120", e.g., rendering them substantially co-axial. Alternatively, cavity 122 may be defined by leads 112, device 130, leads 132, 134, and/or the base of LED 110, e.g., where body 120, 120', 120" is molded over previously assembled elements 110, 130.

Also typically, body 120, 120', 120" has a transverse slot or groove 125 on its rearward end intersecting the hole 126 exiting cavity 122. Thus, lead 134 may conveniently be bent to lie in slot 125, thereby to hold light source 110 in a desired position relative to body 120, 120', 120". Transverse slot or groove 125 may meet longitudinal slot or groove 124, as illustrated, but need not do so. As above, the depths of slots 124 and 125 are less than the dimensions of leads 112, 114 and 134 so that leads 112 and 114 or leads 114 and 134 make electrical contact with housing 20 and battery 60 as described.

Electrical device 130 provides a current limiting device disposed in the central cavity 122 of the cylindrical body 120, 120', 120" and having first and second electrical leads 132, 134. The first electrical lead 132 of the current limiting device 130 is connected to the first electrical lead 112 of the LED light source 110 and the second electrical lead 134 of the current limiting device 130 extends through the central cavity 122 of the cylindrical body 120, 120', 120" at a second end thereof distal the LED light source 110. A sealing O-ring 116 may surround the body of light source 110 as described above.

Flashlight 10 as described provides the advantages of a very small diameter housing 20 and a relatively high intensity light source 110 that has very long useful life, e.g., in excess of 100,000 hours, and operates for a long time, e.g., over 10 hours, on a set of batteries. Advantage may obtain owing to the resilient member, e.g., O-ring 118 or resilient electrically conductive member 118', providing a relatively controlled and consistent contact force between lead 114 and/or conductive ring 118' and housing 20. An additional advantage may obtain due to the water resistance provided by O-rings 116, 38 and 214 providing seals between the light source 110 and housing 20, tail cap 40 and housing 20, and between pushbutton 210 and tail cap 40, respectively.

While the present invention has been described in terms of the foregoing example embodiments, variations within the scope and spirit of the present invention as defined by the claims following will be apparent to those skilled in the art. For example, the length of cylindrical body 120, 120', 120" may be made shorter or longer as is desired, and the other dimensions thereof may be selected to accommodate other requirements. If O-ring 118 is of a relatively softer resilient material, then a larger cross-section O-ring may be utilized and groove 128 might be correspondingly deeper and/or wider, and if O-ring 118 is of a relatively harder resilient material, then a smaller cross-section O-ring may be utilized and groove 128 might be correspondingly shallower and/or narrower. Similarly, the dimensions and flexibility and/or resiliency of sleeve or ring 118' may be adjusted in view of the properties of the material of which it is made and the relative dimensions of dielectric body 120" and the housing into which it is to be positioned, typically as a press fit.

O-ring 118, which provides a resilient member, need not be of circular cross-section, but may be of an oval or rectangular or other desired cross-sectional shape. In fact, resilient member 118 need not be a ring, but could be a drop or piece of resilient material attached to body 120' and/or lead 114, or may be a piece of resilient material in a hole or recess in body 120' other than a circumferential groove around body 120'. Alternatively, resilient member 118 may be a spring, e.g., a helical spring disposed in a radial hole or recess in body 120' to urge lead 114 away from body 120', or a circular spring disposed in groove 128 and having a circumference that is greater than the circumference of body 120' so as to urge lead 114 away from body 120'. The circular spring may have a break therein at which an end thereof is turned radially inward and is disposed in a radial hole in body 120'.

Further, resilient member 118' may be a sleeve or ring or cup or helical spring or other spring or member surrounding body 120" and lead 114 for bearing thereagainst for providing an electrical contact at the periphery of body 120", and may extend part way or entirely around body 120".

Further, while the light source assembly 100, 100', 100" is described as including a solid state light source 110, such as an LED, as is preferred, light source 110 may be a conventional lamp, such as an incandescent, xenon, krypton or other light bulb or lamp. In any case, it is preferred that the light source 110 have two electrical leads extending from the base end thereof, e.g., as does a bi-pin bulb or a two-leaded lamp, so as to cooperate with cylindrical body 120, 120' as described.

By way of further example, and optionally, pushbutton 1210 may have a circumferential groove 1212 for receiving O-ring 214, and/or housing 20 or tail cap 40 may have a groove for receiving O-ring 38, where it is desired to provide a seal resistant to moisture or other undesirable matter. Also optionally, the larger diameter portion 1228 of spring 1226 may have a greater diameter at end **1228*a* distal smaller diameter portion 1227 than at end 1228*b***.

A clip may be installed onto housing 20 to provide a simple means for securing flashlight 10 in the pocket of a user's garment or apron or the like. In addition, either or both of housing 20 and tail cap 40 may be knurled or spiral grooved to provide a better gripping surface for facilitating the relative rotational movement of housing 20 and tail cap 40 for the turning on and off of flashlight 10.

In addition, protective electrical resistor 130 of light source assembly 100, 100' or 100" could be eliminated or could be replaced by another electrical device, e.g., a field-effect transistor current limiter, that would limit the current that could flow through LED light source 110 to a safe level.

What is claimed is:

1. A light source assembly comprising:

a dielectric body having an exterior surface defining first and second ends thereof;

a light source mounted proximate the first end of said dielectric body and having first and second electrical leads extending from an end thereof proximate said dielectric body, said first electrical lead extending into said dielectric body for providing an electrical lead at the second end thereof distal said light source, and said second electrical lead being disposed proximate the exterior surface of said dielectric body for providing an electrical lead at the exterior surface of said dielectric body;

a resilient member bearing against said dielectric body and the second electrical lead for providing an electrical contact of the second electrical lead; and a metal member having a bore, wherein said light source assembly is disposed in the bore of said metal member with the second electrical lead and/or said resilient member being in electrical contact with the bore of said metal member.

2. The light source assembly of claim 1 wherein said resilient member is between said dielectric body and the second lead for urging the second lead away from said dielectric body, or wherein the second electrical lead is between the resilient member and said dielectric body for urging the resilient member away from said dielectric body.

3. The light source assembly of claim 1 wherein said resilient member is either electrically insulating or electrically conductive.

4. The light source assembly of claim 1 wherein said resilient member is electrically conductive and extends beyond the second electrical lead of said light source for providing an electrical contact at the exterior surface of said dielectric body.

5. The light source assembly of claim 1 wherein said resilient member includes either an electrically-conductive O-ring around said dielectric body and in part between the second electrical lead and said dielectric body, or an electrically-conductive ring, sleeve, cup or helix disposed around at least part of said dielectric body and over the second electrical lead.

6. The light source assembly of claim 1 wherein said dielectric body has a slot on the exterior surface thereof, and wherein at least part of the second electrical lead is disposed in the slot.

7. The light source assembly of claim 1 further comprising a current limiting device disposed in said dielectric body, a first electrical lead of said current limiting device being connected to the first electrical lead of said light source and a second electrical lead afraid current limiting device extending through said dielectric body for providing the electrical lead at the second end thereof distal said light source.

8. A light source assembly comprising:

a dielectric body having an exterior surface defining first and second ends thereof;

a light source mounted proximate the first end of said dielectric body and having first and second electrical leads extending from an end thereof proximate said dielectric body, said first electrical lead extending into said dielectric body for providing an electrical lead at the second end thereof distal said light source, and said second electrical lead being disposed proximate the exterior surface of said dielectric body for providing an electrical lead at the exterior surface of said dielectric body;

an electrically-conductive resilient member bearing against said dielectric body and the second electrical lead, wherein said electrically-conductive resilient member is between said dielectric body and the second lead or wherein the second electrical lead is between the electrically-conductive resilient member and said dielectric body, for providing an electrical contact for the second electrical lead; and a metal remember having a bore, wherein said light source assembly is disposed in the bore of said metal member with the second electrical lead and/or said electrically-conductive resilient member being in electrical contact with the bore of said metal member.

9. The light source assembly of claim 8 wherein said electrically-conductive resilient member includes either an electrically-conductive O-ring around said dielectric body and in part between the second electrical lead and said dielectric body or an electrically-conductive ring, sleeve, cup or helix disposed around at least part of said dielectric body and over the second electrical lead.

10. The light source assembly of claim 8 wherein said dielectric body bas a slot on the exterior surface thereof, and wherein at least part of the second electrical lead is disposed in the slot.

11. The light source assembly of claim 8 further comprising a current limiting device disposed in said dielectric body, a first electrical lead of said current limiting device being connected to the first electrical lead of said light source and a second electrical lead of said current limiting device extending through said dielectric body for providing the electrical lead at the second end thereof distal said light source.

12. A light source assembly comprising:

a metal member having a bore; and a hole at an end thereof;

a dielectric body in the bore and having an exterior surface defining first and second ends thereof;

a light source mounted proximate the first end of said dielectric body in the bore and having first and second electrical leads extending from an end thereof proximate said dielectric body, said first electrical lead extending into said dielectric body for providing an electrical lead at the second end thereof distal said light source, and said second electrical lead being disposed proximate the exterior surface of said dielectric body for providing an electrical lead at the exterior surface of said dielectric body; and a resilient member bearing against said dielectric body and the second electrical lead for providing an electrical connection between the second electrical lead and the bore of said metal member, wherein said resilient member is either between said dielectric body and the second lead for urging the second lead against the bore of said metal member, or wherein the second electrical lead is between the resilient member and said dielectric body for urging the resilient member against the bore of said metal member.

13. The light source assembly of claim 12 wherein said resilient member is either electrically insulating or electrically conductive.

14. The light source assembly of claim 12 wherein said resilient member is electrically conductive and extends beyond the second electrical lead of said light source for providing an electrical contact at the exterior surface of said dielectric body.

15. The light source assembly of claim 12 wherein said resilient member includes either an electrically-conductive O-ring around said dielectric body and in part between the second electrical lead and said dielectric body, or an electrically-conductive ring, sleeve, cup or helix disposed around at least part of said dielectric body and over the second electrical lead.

16. The light source assembly of claim 12 wherein said dielectric body has a slot on the exterior surface thereof, and wherein the second electrical lead is disposed in the slot.

17. The light source assembly of claim 12 further comprising a current limiting device disposed in said dielectric body, a first electrical lead of said current limiting device being connected to the first electrical lead of said light source and a second electrical lead of said current limiting device extending through said dielectric body for providing the electrical lead at the second end thereof distal said light source.

18. The light source assembly of claim 12 wherein the light source extends into and/or through the hole at the end of the metal member.

19. A light source assembly comprising:

a metal member having a bore; and a hole at an end thereof;

a dielectric body in the bore and having an exterior surface defining first and second ends thereof;

a light source mounted proximate the first end of said dielectric body and having first and second electrical leads extending from an end thereof proximate said dielectric body, said first electrical lead extending into said dielectric body for providing an electrical lead at the second end thereof distal said light source, and said second electrical lead being disposed proximate the exterior surface of said dielectric body for providing an electrical lead at the exterior surface of said dielectric body; and an electrically-conductive resilient member bearing against said dielectric body and the second electrical lead, wherein said electrically-conductive resilient member is between said dielectric body and the second lead or wherein the second electrical lead is between the electrically-conductive resilient member and said dielectric body, for providing an electrical connection between the second electrical lead and the bore of said metal member, wherein said electrically-conductive resilient member includes either:

an electrically-conductive O-ring around said dielectric body and in part between the second electrical lead and said dielectric body, wherein the second electrical lead is in electrical contact with the bare of said metal member; or an electrically-conductive ring, sleeve, cup or helix disposed around at least part of said dielectric body and over the second electrical lead, wherein the electrically-conductive ring, sleeve, cup or helix is in electrical contact with the bore of said metal member.

20. The light source assembly of claim 19 wherein said dielectric body has a slot on the exterior surface thereof, and wherein at least part of the second electrical lead is disposed in the slot.

21. The light source assembly of claim 19 further comprising a current limiting device disposed in said dielectric body, a first electrical lead of said current limiting device being connected to the first electrical lead of said light source and a second electrical lead of said current limiting device extending trough said dielectric body for providing the electrical lead at the second end thereof distal said light source.

22. The light source assembly of claim 19 wherein the light source extends into and/or through the hole at the end of the metal member.

23. A light source assembly comprising:

a dielectric body having an exterior surface defining first and second ends thereof;

a light source mounted proximate the first end of said dielectric body and having first and second electrical leads extending from an end thereof proximate said dielectric body, said first electrical lead extending into said dielectric body for providing an electrical lead at the second end thereof distal said light source and said second electrical lead being disposed proximate the exterior surface of said dielectric body for providing an electrical lead at the exterior surface of said dielectric body;

an electrically-conductive annular member bearing on said dielectric body and the second electrical lead for providing an electrical contact at the exterior surface of said dielectric body; and a metal member having a bore, wherein said light source assembly is disposed in the bore of said metal member with said electrically-conductive annular member in electrical contact with the bore of said metal member.

24. The light source assembly of claim 23 wherein said electrically-conductive annular member includes an electrically-conductive ring, sleeve, cup or helix around the exterior surface of said dielectric body.

25. The light source assembly of claim 23 wherein said electrically-conductive annular member includes brass, copper, aluminum, a soft metal, and/or a material filled with electrically-conductive particles of copper, silver, carbon, brass, gold, nickel, graphite, silver-glass, silver-copper and/or silver-nickel.

26. A light source assembly comprising:

a dielectric body having a longitudinal slot on a periphery thereof;

a light source mounted proximate an end of said dielectric body and having first and second electrical leads extending toward said dielectric body, said first electrical lead being disposed in said dielectric body for providing an electrical lead at an end thereof distal said light source and said second electrical lead being disposed in the longitudinal slot thereof for providing an electrical lead at the periphery of said dielectric body;

an electrically-conductive annular member bearing on said dielectric body and the second electrical lead for providing an electrical contact at the exterior surface of said dielectric body; and a metal member having a bore, wherein said light source assembly is disposed in the bore of said metal member with said electrically-conductive annular member in electrical contact with the bore of said metal member.

27. The light source assembly of claim 26 wherein said electrically-conductive annular member includes an electrically-conductive ring, sleeve, cup or helix around the exterior surface of said dielectric body and having an interior surface in electrical contact with the second electrical lead.

28. The light source assembly of claim 26 wherein said electrically-conductive annular member includes brass, copper, aluminum, a soft metal, and/or a material filled with electrically-conductive particles of copper, silver, carbon, brass, gold, nickel, graphite, silver-glass, silver-copper and/or silver-nickel.

29. The light source assembly of claim 26 wherein said electrically conductive annular member includes a resilient member and:

wherein said resilient member is electrically conductive and extends beyond the second electrical lead of said light source for providing an electrical contact at the exterior surface of said dielectric body; or wherein said resilient member is an O-ring around said dielectric body.

30. The tight source assembly of claim 26 wherein said electrically conductive annular member includes a resilient member and wherein said resilient member urges the second electrical lead of said light source to electrically contact the bore of said metal member.

31. The light source assembly of claim 30 wherein said resilient member is electrically conductive for providing an electrical connection between the second electrical lead and the bore of said metal member.

32. A light source assembly comprising:

a cylindrical body of a dielectric material having a longitudinal slot on an exterior surface thereof, the exterior surface defining a periphery;

a solid state light source mounted coaxially proximate an end of said cylindrical body and having first and second electrical leads extending from an end thereof proximate said cylindrical body, said first electrical lead extending into said cylindrical body and said second electrical lead being disposed in the longitudinal slot thereof;

an electrically-conductive annular member disposed around the exterior surface of said cylindrical body for providing an electrical contact for the second lead of said solid state light source at the periphery of said cylindrical body;

means exhibiting resistance for extending the first electrical lead of said solid state light source through said cylindrical body at an end thereof distal said solid state light source; and a metal housing having a cylindrical bore in which said light source assembly is disposed, wherein at least said electrically-conductive annular member of said light source assembly contacts the bore of said metal housing for making electrical connection thereto.

33. The light source assembly of claim 32 wherein said means exhibiting includes resistance an electrical device having a first lead connecting to the first electrical lead of said solid state light source and having a second lead extending through said cylindrical body at the end thereof distal said solid state light source.

34. The light source assembly of claim 33 wherein said electrical device is a resistor, a carbon resistor, a current limiter and/or a field effect transistor current limiter.

35. The light source assembly of claim 32 wherein said cylindrical body with the second electrical load disposed in the longitudinal slot thereof and said electrically-conductive annular member thereon is a press fit in the cylindrical bore of said metal housing.

36. The light source assembly of claim 32 wherein said metal housing has a hole at an end thereof extending axially from the cylindrical bore therein, and wherein said solid state light source extends into and/or through the hole in the end of said metal housing.

37. The light source assembly of claim 32 wherein the second electrical lead of said solid state light source contacts the bore of said metal housing for making electrical connection thereto.

38. The light source assembly of claim 32 wherein said cylindrical body is a rigid dielectric material, a moldable plastic, a ceramic, and/or a glass-filled PBT plastic.

39. The light source assembly of claim 32;

wherein said solid state light source is a light emitting diode; and/or wherein said electrically-conductive annular member includes an electrically-conductive O-ring surrounding said cylindrical body and in electrical contact with the second electrical lead; and/or wherein said electrically-conductive annular member includes an electrically-conductive metal ring, sleeve, cup or helix around the exterior surface of said dielectric body and having an interior surface in electrical contact with the second electrical lead.

40. The light source assembly of claim 32 further comprising an O-ring surrounding said solid state light source.

41. A light source assembly comprising:

a cylindrical body of a dielectric material having a longitudinal slot on an exterior surface thereof, the exterior surface defining a periphery;

an LED solid state light source mounted coaxially proximate an end of said cylindrical body and having first and second electrical leads extending from an end thereof proximate said cylindrical body, said first electrical lead extending into said cylindrical body and said second electrical lead being disposed in the longitudinal slot thereof;

an electrically-conductive annular metal member disposed around the exterior surface of said cylindrical body for making electrical connection to the second lead of said LED solid state light source and providing an electrical contact at the periphery of said cylindrical body;

means exhibiting resistance for extending the first electrical lead of said LED solid state light source through said cylindrical body at an end thereof distal said solid state light source; and a metal housing having a cylindrical bore in which said light source assembly is disposed, wherein said electrically-conductive annular metal member of said light source assembly contacts the bore of said metal housing for making electrical connection thereto.

42. The light source assembly of claim 41 wherein said means exhibiting resistance includes an electrical device having a first lead connecting to the first electrical lead of said LED solid state light source and having a second lead extending through said cylindrical body at the end thereof distal said solid state light source.

43. The light source assembly of claim 42 wherein said electrical device is a resistor, a carbon resistor, a current limiter and/or a field effect transistor current limiter.

44. The light source assembly of claim 41 wherein said cylindrical body with the second electrical lead disposed in the longitudinal slot thereof and said electrically-conductive annular metal member thereon is a press fit in the cylindrical bore of said metal housing.

45. The light source assembly of claim 41 wherein said metal housing has a hole at an end thereof extending axially from the cylindrical bore therein, and wherein said solid state light source extends into and/or through the hole in the end of said metal housing.

46. The light source assembly of claim 41 wherein said cylindrical body is a rigid dielectric material, a moldable plastic, a ceramic, and/or a glass-filled PBT plastic.

* * * * *